United States Patent [19]

Howard

[11] Patent Number: 4,894,019

[45] Date of Patent: Jan. 16, 1990

[54] TORSION SPRING SHORTING CONNECTOR

[75] Inventor: William A. Howard, Burton, Ohio

[73] Assignee: Delta Systems, Inc., Streetsboro, Ohio

[21] Appl. No.: 372,212

[22] Filed: Jun. 20, 1989

Related U.S. Application Data

[63] Continuation of Ser. No. 208,142, Jun. 16, 1988, abandoned.

[51] Int. Cl.[4] ..... H01R 13/703

[52] U.S. Cl. ..... 439/188; 200/51.09

[58] Field of Search ..... 439/188; 200/51.09, 200/51.1, 51.12

[56] References Cited

U.S. PATENT DOCUMENTS

| | | | |
|---|---|---|---|
| 1,184,105 | 5/1916 | Klein | 439/188 |
| 1,711,397 | 4/1929 | Rumble . | |
| 2,012,696 | 8/1935 | Sorenson et al. | 173/332 |
| 3,090,948 | 5/1963 | Cremer | 340/280 |
| 3,523,212 | 8/1970 | Murphy | 315/291 |
| 3,903,388 | 9/1975 | Moyer et al. | 200/51.1 |
| 4,157,542 | 6/1979 | Smith | 340/568 |
| 4,230,386 | 10/1980 | Karnworth et al. | 439/188 |
| 4,358,135 | 11/1982 | Tsuge et al. | 200/51.1 |
| 4,594,490 | 6/1986 | McCullough | 200/51.09 |
| 4,685,887 | 8/1987 | Hanning | 439/188 |

FOREIGN PATENT DOCUMENTS

| | | | |
|---|---|---|---|
| 1197299 | 7/1970 | United Kingdom | 200/51.1 |

*Primary Examiner*—Gary F. Paumen

*Attorney, Agent, or Firm*—Watts, Hoffmann, Fisher & Heinke

[57] ABSTRACT

A shorting connector for engaging a switch. A connector housing encloses two spaced apart contacts that form part of a circuit controlled by a switch. In the event that the switch is separated from the connector a torsion spring shorted element moves within the connector housing and bridges the spaced apart contacts to maintain a closed circuit.

7 Claims, 3 Drawing Sheets

TORSION SPRING SHORTING CONNECTOR

This is a continuation of co-pending application Ser. No. 07/208,1423 filed on 6-16-88, now abandoned.

TECHNICAL FIELD

The present invention relates to an electrical connector and more particularly relates to an electrical connector having structure which shorts together connector contacts if the connector becomes disconnected from a mating connector.

BACKGROUND ART

Electrical connectors are commonly used in electrical circuits to connect different circuit components without the necessity for soldering those components together. As an example, switches are often inserted into electrical circuits by means of electrical connectors which engage the switch and allow the switch to control operation of an electrical circuit.

A typical switch has contacts that are either normally open or normally closed. For a normally closed switch, unless user actuation of the switch causes the switch contacts to open, an electrical circuit is made through the switch. Choice of a normally closed switch may be desirable in certain instances in which it is necessary that the switch maintain electrical engagement normally and only open the circuit under certain conditions such as user actuation of the switch.

U.S. Pat. No. 3,523,212 which issued to Murphy on Aug. 4, 1970 discloses a switch receptacle or connector having a mechanism for accommodating a dimmer switch in addition to a more traditional on/off switch for a light fixture. When the dimmer switch is withdrawn from the receptacle of Murphy, the circuit short circuits the dimmer control contacts and allows the switch to operate in a traditional on/off mode. When the portable dimmer unit is inserted into the receptacle, however, the shorting elements of the receptacle are spread apart by the dimmer switch and control can be achieved by adjusting the dimmer switch. This is an instance in which once the dimmer control is removed, it is desirable that the switch contacts be shorted together to allow the circuit to operate in a conventional on/off mode.

An additional example of a shorting connector is disclosed in U.S. Pat. No. 4,358,135 to Tsuge which issued Nov. 9, 1982. The '135 patent shows a receptacle having normally shorted together contacts which are opened by insertion of a corresponding mating socket. More specifically, signal carrying leads are grounded when the mating connector is removed. The connector disclosed in the '135 patent is for use in a vehicle restraint system.

In both the aforementioned prior art patents, the shorting element of the connector serves as part of the electrical circuit during normal circuit operation. Stated another way, the shorting connector of the receptacle engages the contact of the mating socket and in the absence of the socket, the shorting connector is biased to a particular position.

DISCLOSURE OF THE INVENTION

The present invention concerns a connector that engages a switch or other circuit element to complete an electrical circuit. Should the connector become disconnected from the circuit element, a shorting element carried by the connector in the form of a torsion spring bridges connector contacts and thus assures the circuit is made even though the switch or other element is disconnected.

In one embodiment of the invention a connector housing defines spaced apart walls that define a housing interior that encloses spaced apart metal contacts. A passageway routes signal carrying conductors into the housing where they are electrically coupled to the metal contacts. The housing interior also includes ribs which extend a portion of the length of the housing and separate the two metal contacts as well as defining a slot or passageway between the ribs.

An actuator within the housing interior is supported within the slot for movement through the housing. A portion of the actuator is exposed in a position between the two connector contacts so that when a mating connector is coupled to the connector the actuator is pushed into the housing. A torsion spring shorting element is coupled to the actuator and positioned within the slot in such a way that inward movement of the actuator compresses two elongated legs of the spring together, moving the legs out of contact with the spaced apart connector contacts. So long as the mating connector is engaging the connector housing, the torsion spring is out of contact with the spaced apart metal connector contacts. In the event the mating connector is separated from the connector, however, the torsion spring moves the actuator through the housing in such a way that the legs short across the spaced connector contacts. This situation is maintained until a mating connector is again coupled to the connector. By shorting across the contacts, a closed loop circuit is maintained in the electrical circuit of which the shorting connector forms a part.

The preferred torsion spring is a multiple turn spring element mounted to an actuator mounting post and movable with the actuator between first and second positions. In one position, the torsion spring arms extend away from the coiled portion of the spring to bridge the gap between connector contacts. In the closed or compressed position the actuator moves the spring in response to engagement with the mating connector and causes the spring arms to move down the slot to a position where edges of the ribs compress the spring together and move the elongated arms out of engagement with the connector contacts.

The mating connector may be fitted with a protuberance, e.g., a rib or prominence, to facilitate engagement with the actuator. While it is preferable for a portion of the actuator to extend beyond the housing to contact the mating connector, the actuator may be entirely enclosed by the housing to be engaged by the protuberance on the mating connector. Similarly, while the preferred embodiment of the present shorting connector may be in a female device, the present shorting connector may be embodied in a male device or in some other form of connector.

While one intended use of the invention is for connecting a switch element to a controlled circuit, the shorting connector of the invention has applicability in any situation where an open circuit condition is to be avoided in the event a circuit element is disconnected.

From the above it is appreciated that one object of the invention is a new and improved shorting connector that utilizes a torsion spring as a shorting element. This and other objects, advantages and features of the invention will become better understood from a detailed description of a preferred embodiment of the invention which is described in conjunction with the accompanying drawings.

BEST MODE FOR CARRYING OUT THE INVENTION

Figure 1:
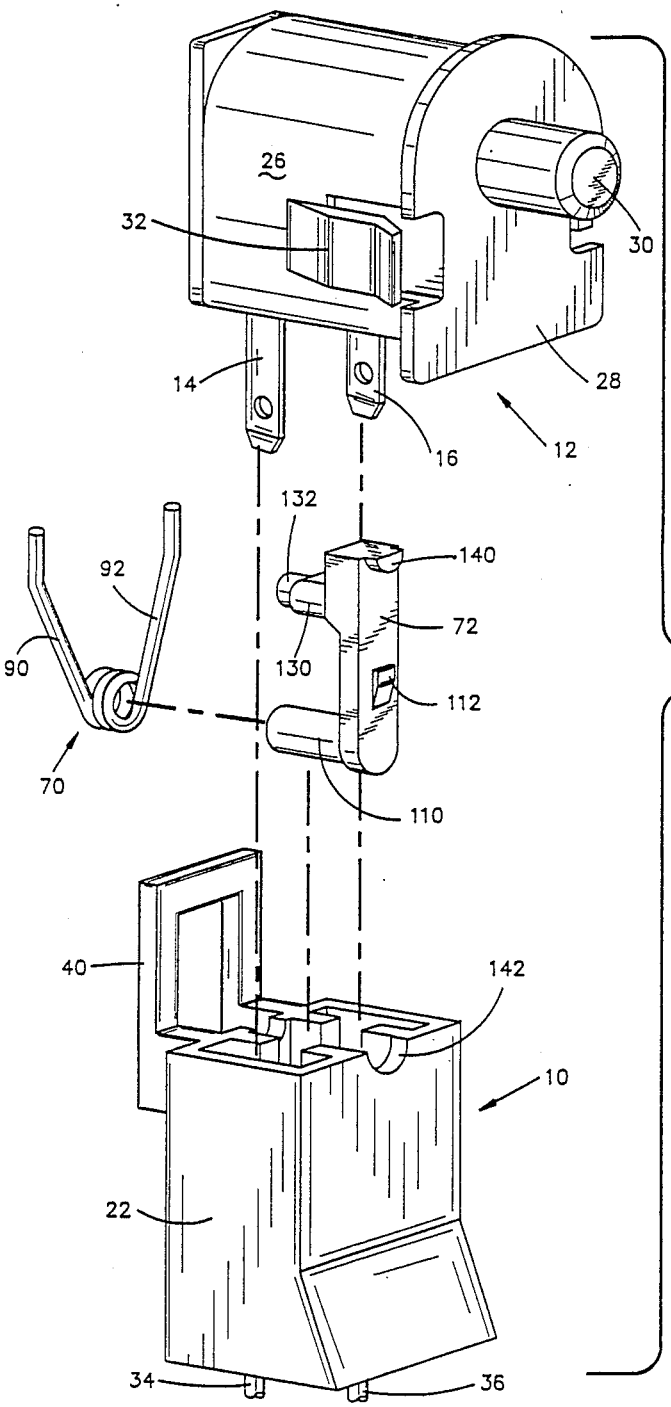
FIG. 1 is a perspective view showing a shorting connector and a switch that engages the shorting connector.
Figure 2:
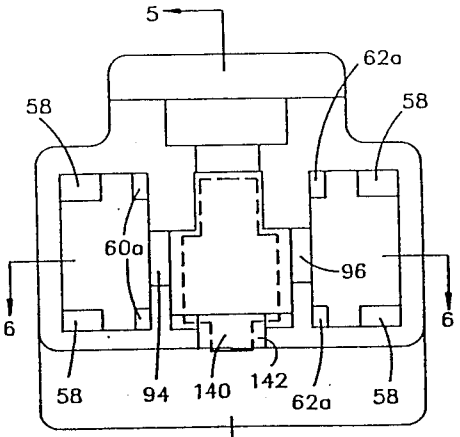
FIG. 2 is an end elevation view of the FIG. 1 shorting connector.

FIG. 1 is a perspective view showing a connector 10 for coupling a switch 12 to a circuit. The switch 12 includes switch contacts 14, 16 that engage spaced connector contacts 20 (FIG. 2) supported within a connector housing 22. The switch contacts 14, 16 are mounted to a switch housing 26 configured for mounting the switch 12 to a panel. The housing 26 is defined in part by a panel engaging ball 28 that defines an opening to accommodate a switch actuator 30. During installation of the switch, the housing is pushed through a suitably defined opening in the panel to which the housing is mounted and held in place by flexible arms 32 which can be compressed as the housing 26 is pushed through the panel and then returned to an uncompressed state once the arms have cleared the through passage in the panel. This locks the switch 12 in place so that the actuator 30 is accessible from the front of the panel and the two switch contacts 14, 16 extend away from the switch housing 26 behind the panel.

To incorporate the switch 12 into a control circuit whereby user actuation of the push button actuator 30 opens and closes the circuit, the connector 10 is mated with the switch 12 by pushing the switch contacts 14, 16 into the connector housing 22 to couple the contacts 14, 16 with the connector contacts 20. This couples the switch to the remaining portions of the circuit by insulated conductors 34, 36 leading away from the connector housing 22.

When the switch contacts 14, 16 are mated with the connector contacts 20, a connector coupling 40 extending away from the connector housing 22 engages a tab (not shown in FIG. 1) on the switch housing 26 to help maintain the connector 10 and switch 12 in engagement.

Figure 5:
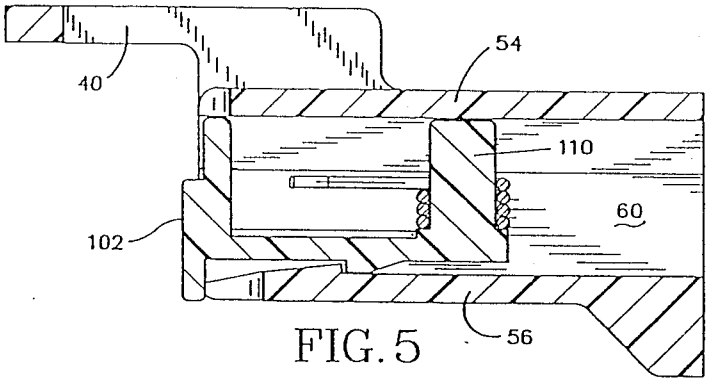
FIGS. 5 and 6 are sectioned side and top views showing a torsion spring shorting element bridging a gap between two connector contacts.
Figure 6:
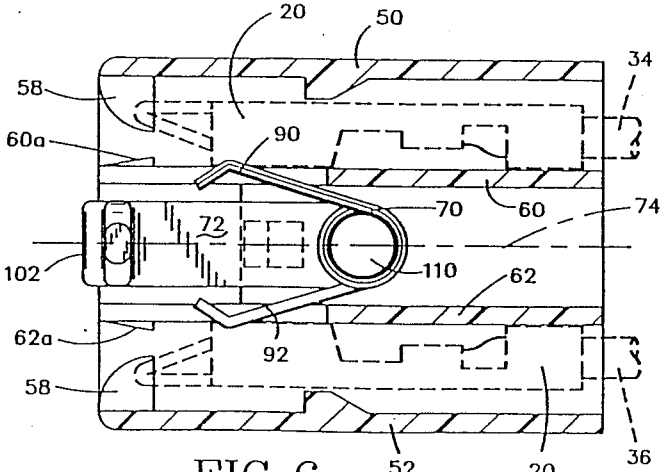

FIG. 6 is a partially sectioned view showing an interior of the connector housing 22. Spaced, generally parallel side walls 50, 52 in combination with top and bottom walls 54, 56 (FIG. 5) define a center cavity for housing the two connector contacts 20. The contacts 20 are maintained within the connector housing by inwardly extending tabs 58 which in combination with housing ribs 60, 62 running the length of the connector housing fix the contacts 20 as positioned in FIG. 6. The switch contacts 14, 16 are guided into the connector housing 22 by two tabs 58 extending from the side walls 50, 52 and a cam portion **60*a*, 62*a* of the ribs 60, 62 beveled inward to define an entryway for the switch contacts 14, 16**.

A torsion spring shorting element 70 carried by an actuator 72 is supported for movement within a slot defined by the spaced ribs 60, 62 and assures that the two contacts 20 are shorted together unless a mating connector such as the switch 12 has been coupled to the connector 10. In the FIG. 6 depiction, the connector 10 has been disconnected from the switch 12. The actuator 72 is moved along a path of travel defined by the center line 74 of FIG. 6 through the slot defined by the ribs 60, 62 until the torsion spring 70 bridges the connector contacts 20.

Figure 3:
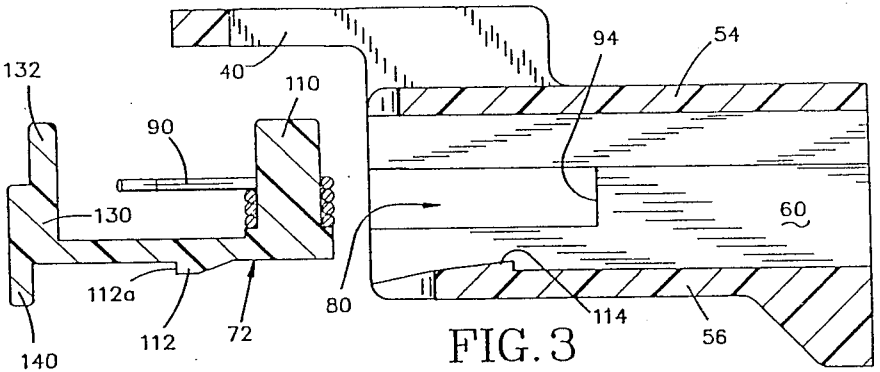
FIG. 3 is a section view of the shorting connector as seen from the plane defined by the line 3—3 in FIG. 2.
Figure 4:
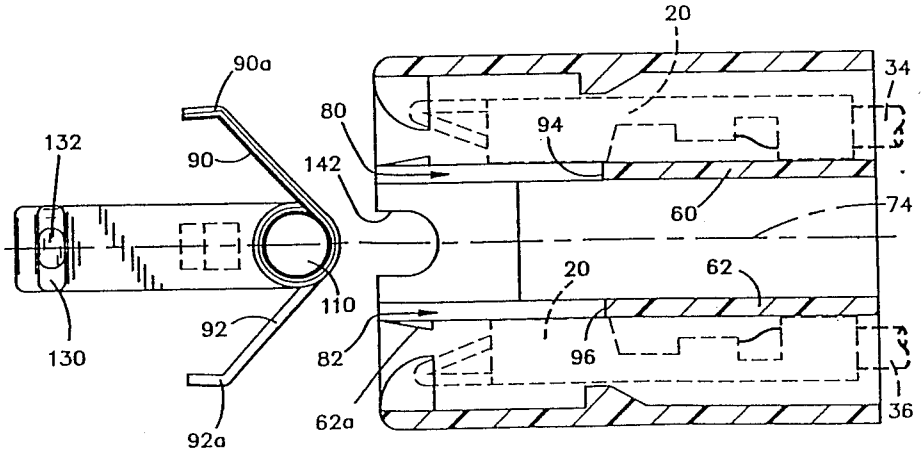
FIG. 4 is a section view as seen from the plane defined by the line 4—4 in FIG. 2.

As seen most clearly in FIGS. 3 and 4 the two ribs 60, 62 define cutouts or notches 80, 82 through which outwardly extending torsion spring arms 90, 92 extend to engage the connector contacts 20. The arms 90, 92 are bent near their ends to form contact regions **90*a*, 92*a* to engage the connector contacts 20. A preferred torsion spring 70** is constructed from a stainless steel wire coiled at its center.

As the switch 12 engages the connector 10, a ridge 100 formed in the switch housing 26 engages a contact surface 102 of the actuator 72 that extends beyond the housing 22, pushing the actuator 72 into the housing. Two torsion spring arms (FIG. 8) are compressed together by slot defining edges 94, 96 of the two ribs 60, 62 and move toward each other out of engagement with the contacts 20.

The actuator 72 includes a mounting post 110 which extends away from a center actuator body and carries the spring 70. As seen in the figures, the spring 70 includes three coils at its center with the two spring arms 90, 92 extending away from the center coil. The coils slip over the mounting post 110 and the mounting post 72 and spring 70 are inserted into the housing cavity between the two ribs 60, 62. During insertion of the actuator 72, a latch 112 extending from a surface of the actuator body opposite the carrying post 110 encounters an inwardly extending lip 114 defined by the wall 56. As the actuator 72 is pushed further into the connector cavity, the latch 112 passes the lip 114 and locking surfaces **112*a*, 114*a* prevent withdrawal of the actuator 72 from the connector. The section view of FIG. 5 shows the actuator 72 just after the latch 112 has been pushed past the lip 114 and is trapped within the connector housing. At this position, the torsion spring arms 90, 92 bridge the gap between connector contacts 20** to short circuit those contacts.

Figure 7:
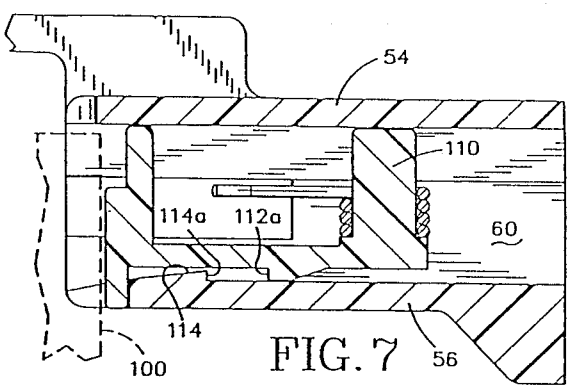
FIGS. 7 and 8 are side and top section views of the FIG. 1 connector showing the connector engaged by a mating connector which moves the torsion spring out of engagement with the spaced contact elements.
Figure 8:
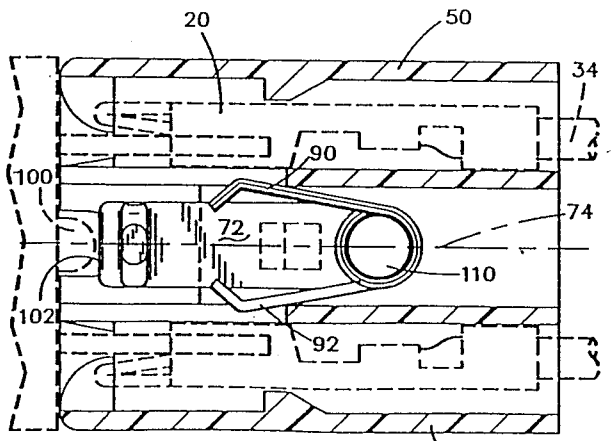

Continued movement of the actuator 72 into the housing, to the position, for example, shown in FIGS. 7 and 8 closes the arms 90, 92 toward each other moving them out of engagement with the two contacts 20. This continued movement, however, also stores energy in the compressed torsion spring so that in the event a mating connector such as the switch 12 of FIG. 1 becomes disconnected from the connector, the stored energy causes the actuator 72 to move along the centerline 74 between the ribs 60, 62 to the contact bridging position shown in FIGS. 5 and 6.

The height of an actuator 72, including the mounting post 110 prevents back and forth movement of the actuator 72 between the two housing walls 54, 56. Extending away from the center body of the actuator 72 at the region of the actuator contact surface 102 is a boss 130 having a width substantially the same as the center actuator body. The boss 130 narrows to a generally oval shaped guide 132 which extends between widened wall portions of the ribs 60, 62. A pin 140 extending away from the actuator body 72 in the region of the contact surface 102 fits within a slot 142 in the wall 56 and contacts a rounded end of the slot 142 when the switch 12 and connector 10 are secured together by means of the latch 40.

Operation

In operation, the connector 10 is coupled to a control circuit by the insulated conductors 34, 36. The switch 12 is installed to a panel or the like with the switch contacts 14, 16 extending away from the switch housing 26. The connector 10 is mated with the switch body 26 by inserting the contacts 14, 16 into the entryway defined in the connector housing 22. The connector 10 is pushed toward the switch body 26 until the latch 40 engages a corresponding lip on the switch housing 26. This secures the connector and switch in operative relationship and pushes the actuator 72 into the connector housing 22 while compressing the two torsion spring arms 90, 92 toward each other. This allows the status of the switch 12 to control the open and closed state of the circuit. In the event, however, the connector 10 is separated from the switch 12 the stored energy within the compressed spring 70 moves the actuator within the connector housing 22 causing the switch arms 90, 92 to move out of engagement with the ribs 60, 62. The connector contacts 20 are shorted together and the circuit remains closed, as if the switch actuator 30 were moved to a position to close the contacts 14, 16.

The invention has been described with a degree of particularity. It is the intent, however, that the invention include all modifications and/or alterations from the disclosed design falling within the spirit or scope of the appended claims.

I claim:

1. Apparatus comprising:

(a) a housing having spaced side walls that define a housing interior for enclosing metal contacts in spaced apart relation and further defining a passageway leading to the housing interior to accommodate passage of signal carrying conductors coupled to the spaced apart metal contacts, said housing defining interior ribs that separate said two metal contacts and define a slot in said housing interior;

(b) an actuator movably supported in said slot for engagement with a mating connector that holds the actuator in a recessed position in the housing when the mating connector is brought into engaging relationship to the housing, said actuator having a post thereon; and (c) a torsion spring shorting wire carried by the actuator and including a central loop embracingly engaging the post mounted on the actuator and having elongated contact portions, said elongated contact portions normally engaging the two metal contacts to short said contacts and being movable out of engagement with said contacts by said interior ribs when the actuator moves said shorting wire into the slot in response to contact by the mating connector said shorting wire biasing the actuator to move the elongated contact portions back into engagement with the two metal contacts if the mating connector becomes disengaged from the housing.

2. The apparatus of claim 1 wherein a portion of the actuator which engages the mating connector is not enclosed by the housing.

3. The apparatus of claim 1 wherein the mating connector includes a protuberance for contacting the actuator when the mating connector is brought into engaging relationship to the housing.

4. A shorting connector comprising:

(a) a housing enclosing two spaced apart metal contacts and having an input end for receiving a mating connector, said housing defining slot with a slot edge facing the input end of the housing;

(b) an actuator movably supported in the slot and having a contact portion for engagement with the mating connector for movement of the actuator within the slot from a first position in the housing to a second position in the housing proximate to the first;

(c) a post fixed on the actuator; and (d) an electrically conductive torsion spring having a loop embracing the post and a pair of biasing arms engaging the slot edge for biasing the actuator toward the first position and away from the second position, said torsion spring constructed and arranged to electrically couple the first and second contacts when the actuator is in the first position and to be deflected away from the first and second contacts as the actuator moves toward the second position due to engagement between the shorting connector and the mating connector.

5. A shorting connector according to claim 4 including signal-carrying conductors and wherein the housing defines first and second passageways external to the slot to route the signal-carrying conductors into the housing for electrical engagement with the first and second contacts.

6. A shorting connector according to claim 4 wherein the mating connector has a protuberance for engagement with the contact portion of the actuator for movement of the actuator toward the second position as the mating and shorting connectors are connected.

7. A shorting connector according to claim 4 wherein the contact portion extends outside the housing at the input end when the actuator is in the first position.

* * * * *